US008278833B2

(12) United States Patent
Gao

(10) Patent No.: US 8,278,833 B2
(45) Date of Patent: Oct. 2, 2012

(54) METHOD OF IGNITION REGULATION OF DISCHARGE LAMP AND THE CORRESPONDING ELECTRONIC BALLAST CIRCUIT

(75) Inventor: Wei Gao, Guangzhou (CN)

(73) Assignee: Osram AG, Munich (DE)

( * ) Notice: Subject to any disclaimer, the term of this patent is extended or adjusted under 35 U.S.C. 154(b) by 373 days.

(21) Appl. No.: 12/531,908

(22) PCT Filed: Mar. 5, 2008

(86) PCT No.: PCT/EP2008/052690

§ 371 (c)(1),
(2), (4) Date: Sep. 18, 2009

(87) PCT Pub. No.: WO2008/119613

PCT Pub. Date: Oct. 9, 2008

(65) Prior Publication Data

US 2010/0134029 A1 Jun. 3, 2010

(30) Foreign Application Priority Data

Mar. 30, 2007 (CN) ..... 2007 1 0092196

(51) Int. Cl.
*H05B 41/36* (2006.01)
*G05F 1/00* (2006.01)

(52) U.S. Cl. ..... 315/224; 315/307

(58) Field of Classification Search ..... 315/224, 315/244, 194, 307, 291, DIG. 4, DIG. 7
See application file for complete search history.

(56) References Cited

U.S. PATENT DOCUMENTS

| | | | | |
|---|---|---|---|---|
| 6,002,214 | A * | 12/1999 | Ribarich | 315/307 |
| 6,008,593 | A | 12/1999 | Ribarich | |
| 7,053,561 | B2 | 5/2006 | Mayer et al. | |
| 7,242,154 | B2 | 7/2007 | Rudolph | |
| 7,259,523 | B2 * | 8/2007 | Veldman et al. | 315/291 |
| 7,388,335 | B2 | 6/2008 | Kaestle | |
| 2006/0181226 | A1 | 8/2006 | Rudolph | |

FOREIGN PATENT DOCUMENTS

| | | | |
|---|---|---|---|
| EP | 1333707 | B1 | 8/2006 |
| EP | 1737279 | A2 | 12/2006 |
| WO | 0024233 | A2 | 4/2000 |
| WO | 2005072024 | A1 | 8/2005 |

OTHER PUBLICATIONS

International Search Report of PCT/EP2008/052690 mailed May 27, 2008.
English language Abstract of EP1333707B1.

* cited by examiner

*Primary Examiner* — Daniel D Chang

(57) ABSTRACT

A method and corresponding electronic ballast circuit for regulating the ignition voltage of a discharge lamp is described. The circuit includes a discharge lamp with an AC operating voltage supplied by a half-bridge inverter circuit comprising two transistors. The method includes detecting the current flowing through one transistor of the two transistors, and comparing the detected current with a predetermined reference value. When the detected current exceeds a predetermined reference value, a driving period of the one transistor is terminated and the driving period of the other transistor of said two transistors is started, and the driving period of said other transistor is made to be the same as the terminated driving period of the one transistor.

12 Claims, 2 Drawing Sheets

METHOD OF IGNITION REGULATION OF DISCHARGE LAMP AND THE CORRESPONDING ELECTRONIC BALLAST CIRCUIT

RELATED APPLICATIONS

The present application is a national stage entry according to 35 U.S.C. §371 of PCT application No. PCT/EP2008/052690 filed on Mar. 5, 2008, which claims priority from Chinese application No. :200710092196.1 filed on Mar. 30, 2007.

TECHNICAL FIELD

The present invention relates to a method of regulating the ignition voltage of a discharge lamp and the corresponding electronic ballast circuit, wherein a half-bridge inverter circuit comprising two transistors supplies AC voltage to the discharge lamp.

BACKGROUND

Due to the behavior of a discharge lamp (e.g. fluorescent lamp), it needs a high voltage, which is much higher than the normal operational voltage and is referred to as start voltage, to break down the gas therein so as to produce a glow discharge. Then the lamp transits to the phase of burning discharge during normal operation. Such behavior requires that the resonant operation circuit should produce a high enough start voltage so as to ignite the fluorescent lamp. Meanwhile, such start voltage should be limited within a certain magnitude in compliance with certain requirements like safety specification etc.

Patent document US 2006/0181226A1 discloses a circuit arrangement for operation of a gas discharge lamp, which has a free-running half-bridge inverter. A stop device St is used in said arrangement to enable the drive to the half-bridge switches only during an on time. The oscillation frequency of the half-bridge inverter can be reliably adjusted by the duration of the on time, and this allows control of the lamp operating variables. In FIG. 1 of this document, the threshold value device Sc compares the current in switch S2 with a predetermined reference value. If the reference value is exceeded, the threshold value device Sc sends an interrupt signal. However, said document does not teach the processing of the following driving period of the other switch S1. In addition, in order to adjust the on time, the circuit taught in said document is very complicated and has a high cost.

Patent document U.S. Pat. No. 7,053,561, B2 also discloses a circuit for operating a discharge lamp, wherein the current through the components of a half-bridge of an electronic ballast is intended to be limited during the starting phase. For this purpose, the gate of a half-bridge transistor T2 is driven by a current limiting circuit (D1, D2, D3, T3, C3) in such a way that the current through the transistors T1, T2 is limited during the starting phase, whereas it remains unlimited during the glow phase and burning phase of the discharge lamp LA. The gate of transistor T2 is controlled such that the current flowing through T2 does not exceed a certain threshold value. During the starting phase of the lamp, the transistor T2 is switched off early, if appropriate, in each switching cycle. But said document does not teach the processing of the following driving period of the other switch T1, either.

SUMMARY

Various embodiments of the present invention provide a method for regulating the ignition voltage of a discharge lamp and the corresponding electronic ballast circuit, which could regulate the ignition voltage of the discharge lamp more readily and effectively. By means of the inventive control, the half-bridge inverter circuit of the ballast may produce a controllable and high enough voltage to start a gas discharge lamp, while such high voltage could be maintained at a certain magnitude.

In the method for regulating the ignition voltage of a discharge lamp according to various embodiments of the present invention, said discharge lamp is supplied with AC operating voltage by a half-bridge inverter circuit comprising two transistors. In said method, the current flowing through one of said two transistors is detected, and the detected current is compared with a predetermined reference value. When the detected current exceeds the predetermined reference value, the driving period of said one transistor is immediately terminated and the driving period of the other of said two transistors is started. Moreover, the started driving period of said other transistor is controlled so that it is the same as the terminated driving period of said one transistor.

The electronic ballast circuit for regulating the ignition voltage of a discharge lamp according to various embodiments of the present invention, comprising: a half-bridge inverter circuit including two transistors for supplying AC voltage to said discharge lamp; a load circuit coupled between said discharge lamp and said half-bridge inverter circuit; and a detector for detecting the current flowing through one of said two transistors; a logic control circuit for comparing the current detected by said detector with a predetermined reference value, and immediately terminating the driving period of said one transistor and starting the driving period of the other of said two transistors if the detected current exceeds the predetermined reference value. Said logic control circuit further controls the started driving period of said other transistor so that it is the same as the terminated driving period of said one transistor.

By means of the above described logic control according to embodiments of the present invention, when the current flowing through the half-bridge exceeds the predetermined level, the switching cycle will be shortened by the shortened cycle of the two transistors, thus the switching frequency will increase immediately and the impedance of the whole load circuit also increases, accordingly, the current flowing through the half-bridge decreases. Since the ignition voltage on the lamp is direct proportional to the current flowing through the half-bridge, the ignition voltage of the lamp also goes down, thus a more effective voltage decreasing is achieved.

In some embodiments, said comparison is carried out by comparing the voltages, that is, the voltage on the shunt resistor connected in series to said one transistor is detected, and said voltage is compared to a reference voltage by a comparator.

According to some embodiments, when said voltage is higher than said reference voltage, said comparator generates an over current signal of high level. Then said over current signal is used to trigger the termination of the driving period of said one transistor and the start of the driving period of said other transistor.

In some embodiments, said two transistors are bi-polar transistors or MOSFETs, and the discharge lamp is low voltage fluorescent lamp.

DESCRIPTION OF THE FIGURES

Embodiments of the present invention are described in detail below with reference to the figures.

DETAILED DESCRIPTION

Figure 1:
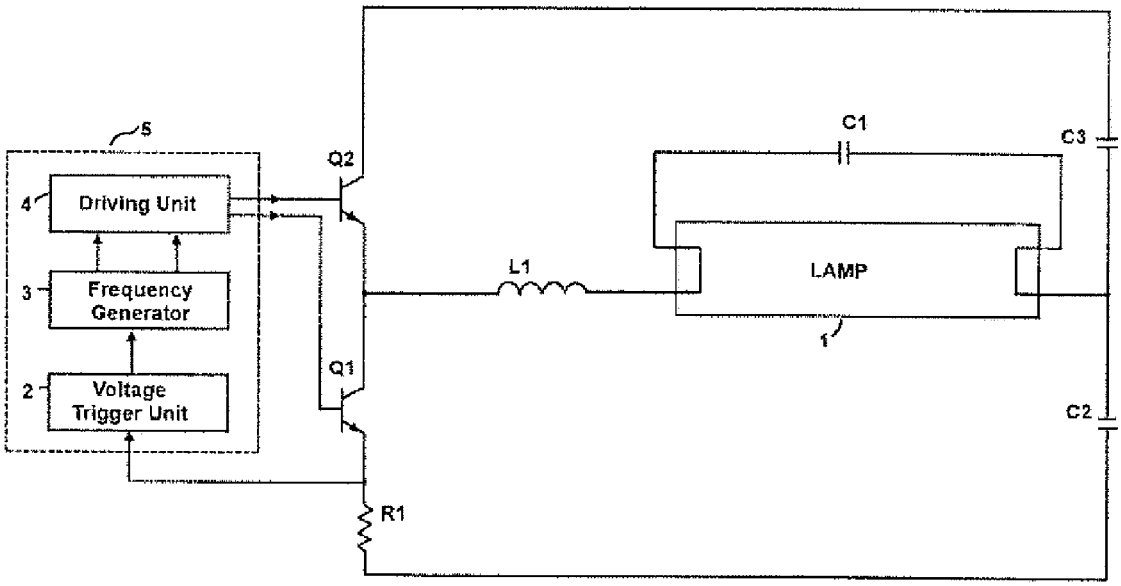
FIG. 1 shows an electronic ballast circuit in accordance with various embodiments of the present invention.

FIG. 1 shows an electronic ballast circuit for regulating the ignition voltage of a discharge lamp according to an embodiment of the present invention. Discharge lamp 1 is supplied with AC voltage by a half-bridge inverter circuit comprising a low side transistor Q1 and a high side transistor Q2. As is customary, a load circuit composed of capacitor, inductor and lamp is connected between said discharge lamp 1 and said half-bridge inverter circuit, wherein when the low side transistor Q1 and the high side transistor Q2 are switched on in turn, inductor L1 forms a resonant loop with capacitors C2 and C3, respectively. Capacitor C1 provides the necessary high ignition voltage for igniting said discharge lamp 1.

A shunt resistor R1 is connected in series to the low side transistor Q1 among the high side and low side transistors for detecting the current flowing through transistor Q1. Said shunt resistor R1 can alternatively be connected in series to the high side transistor Q2.

The reference sign 5 in FIG. 1 shows the block diagram of a logic control circuit for carrying out the function according to an embodiment of the invention. Due to factor of costs, said circuit may be integrated into a IC chip.

A voltage trigger unit 2 is used to detect the current signal through the low side transistor Q1. Said signal derives from a resistor R1. Once said current signal exceeds a certain threshold value, the voltage trigger unit 2 will produce an OC (over current, see the sign "OC" in FIGS. 3 and 4) trigger signal for a frequency generator 3.

The frequency generator 3 may generate a control signal of a desired frequency to control a driving unit 4. Said control signal comprises at least two signals, which are respectively used to control the driving period LSTDP of the low side transistor Q1 and a driving period HSTDP of the high side transistor Q2. Said driving periods LSTDP and HSTDP occur alternatively so that the low side transistor Q1 and the high side transistor Q2 are switched on in turn.

Once the over current signal OC from the voltage trigger unit 2 is detected, said frequency generator 3 immediately terminates the driving periods LSTDP of said transistor Q1. Meanwhile, a driving period HSTDP for the high side transistor is immediately transmitted to the driving unit 4 by the frequency generator 3, which is as long as the shortened driving period LSTDP.

The driving unit 4 produces the really desired driving signal for the transistors based on the signal LSTDP and HSTDP produced by the frequency generator 3. The signal for driving the high side transistor Q2 may only be produced when the signal HSTDP is active, while the signal for driving the low side transistor Q1 may only be produced when the signal LSTDP is active.

Naturally, the operating frequency is maintained unchanged if no OC signal is detected.

Figure 2:
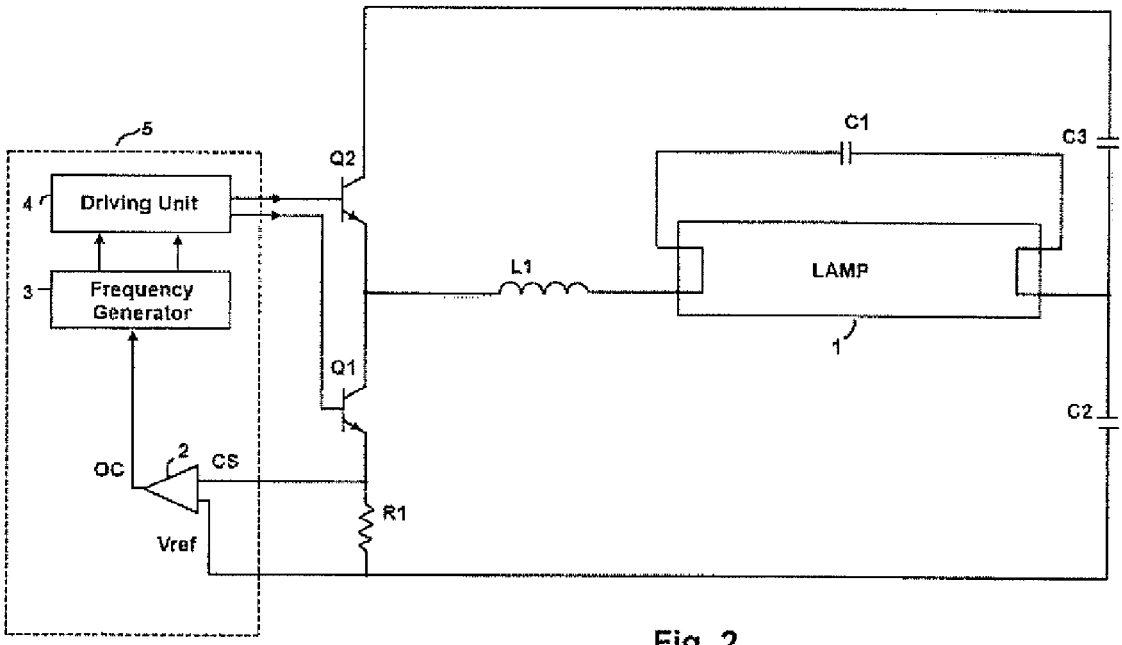
FIG. 2 shows an embodiment of the electronic ballast circuit in accordance with the present invention.

FIG. 2 shows an embodiment of the electronic ballast circuit in accordance with the present invention, wherein the voltage trigger unit is implemented by a comparator 2, which can be any conventional type of comparator. The voltage CS on said shunt resistor R1 is input to an input terminal of said comparator 2, and a reference voltage Vref is input to another input terminal thereof. Said comparator 2 compares said voltage CS and said reference voltage Vref. When voltage CS is higher than reference voltage Vref, said comparator generates an over current signal OC which is the output high level of comparator 2.

Said over current signal OC is used by the frequency generator 3 and the driving unit 4 to immediately terminate the driving period of the low side transistor Q1 and start the driving period of the high side transistor Q2, so that the started driving period of the high side transistor Q2 is the same as the terminated driving period of the low side transistor Q1.

Figure 3:
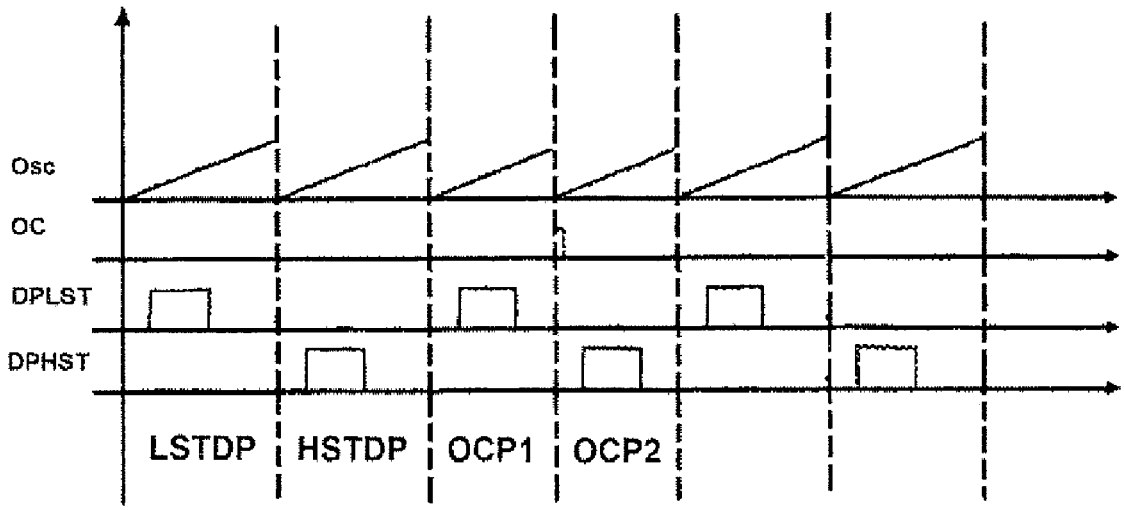
FIG. 3 shows the curves of the control signals during operation of an electronic ballast circuit in accordance with various embodiments of the present invention.

Reference is made to FIG. 3 in the following text. FIG. 3 shows the curves of the control signals during operation of the electronic ballast circuit according to an embodiment of the present invention. Osc represents the clock oscillator signal of the application specific integrated circuit (ASIC). OC represents the curve of said over current signal OC. DPLST represents the driving pulse of the low side transistor Q1 in FIG. 1, and DPHST represents the driving pulse of the high side transistor Q2 in FIG. 1.

As shown in FIG. 2, the whole driving period can be divided into two parts which are a driving period LSTDP of the low side transistor and a driving period HSTDP of the high side transistor. The driving pulse of each transistor is generated in a certain time (e.g. 2 μs) after the driving period starts, and this is represented by the interval between the dash-and-dot lines and the start rising edge of the driving pulse in FIG. 3.

Once the comparator 2 generates over current signal OC in the driving period LSTDP of the low side transistor, said driving period LSTDP of the low side transistor is immediately terminated by the logic control circuit of the present invention, as shown in the driving period OCP1 in FIG. 3. Meanwhile, the driving period HSTDP of the high side transistor is immediately started by the logic control circuit of the present invention, as shown in the driving period OCP2 in FIG. 3. In this circumstance, the driving period OCP1 that is terminated earlier is obviously shorter than the original driving period LSTDP of the low side transistor. The started driving period HSTDP of the high side transistor Q2 is controlled to be the same as the previously terminated driving period OCP1 of the low side transistor Q1, which is indicated as OCP2 herein.

For example, the time interval of the original driving period LSTDP of the low side transistor is 10 μs, but an over current signal is generated at 9 μs, then the driving period LSTDP of the low side transistor is reduced to 9 μs, and the driving period HSTDP of the high side transistor is also reduced to 9 μs instead of being 10 μs. The current flowing through the low side transistor Q1 is detected again in the next driving period LSTDP of the low side transistor, and the above-mentioned process is repeated.

Figure 4:
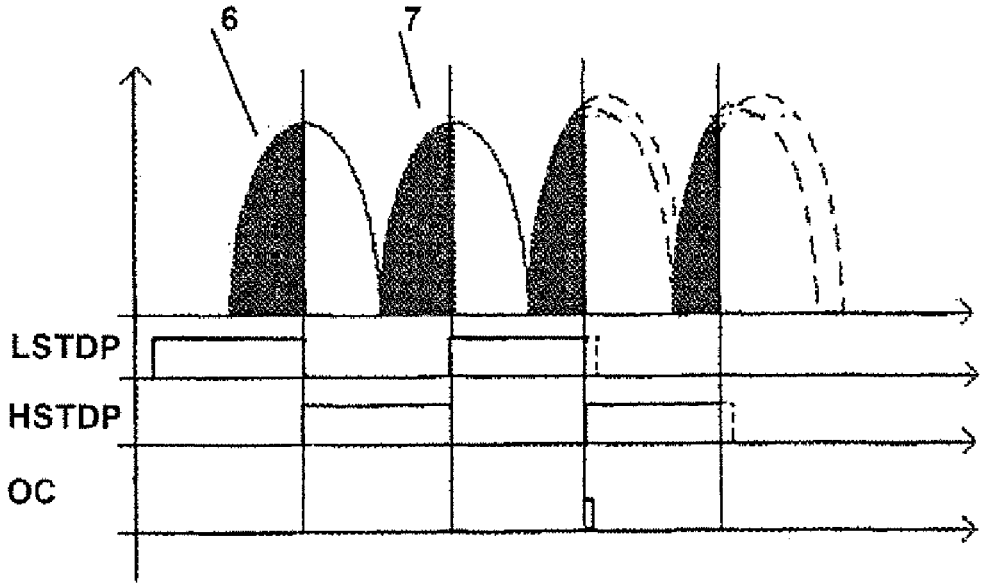
FIG. 4 shows the timing relationship between the currents flowing through the transistors of half-bridge inverter circuit and the driving period thereof.

Based on the aforementioned control logic, FIG. 4 shows in detail the timing relationship between the current 6 through the low side transistor Q1, the current 7 through the high side transistor Q2 (on the one hand) and the driving period LSTDP of the low side transistor Q1, the driving period HSTDP of the high side transistor Q2, and the over current signal OC (on the other hand).

Embodiments of the present invention may be applicable to separately-excited Voltage-Half-bridge Series Resonant Circuit. Transistors Q1 and Q2 may be bi-polar transistors or MOSFETs.

The control according to various embodiments of the invention is widely applicable, hence may be used not only to control the voltage during start of a fluorescent lamp, but also to carry out other protective functions by changing the voltage threshold value for triggering.

It can be seen that by means of such control logic of embodiments of the present invention, when the current flowing through the half-bridge exceeds the predetermined level, the switching cycle will be shortened by the over current signal OC, thus the switching frequency immediately increases and the impedance of the whole circuit also increases. Accordingly, the current flowing through the half-bridge decreases. In addition, since the ignition voltage on the lamp is direct proportional to the current flowing through the half-bridge, the ignition voltage of the lamp is also decreased by the logic control circuit of the present invention, thus a more effective voltage decreasing is achieved during ignition of the lamp.

Furthermore, the logic control circuit of various embodiments of the present invention limits the maximum current flowing through the half-bridge transistors Q1 and Q2 (bi-polar transistors or MOSFETs), the rated current of said transistors are optimized.

What is claimed is:

1. A method for regulating the ignition voltage of a discharge lamp, said discharge lamp being supplied with AC operating voltage by a half-bridge inverter circuit including a first and a second transistor, comprising:

detecting the current flowing through the first transistor;

comparing the detected current with a predetermined reference value; and when the detected current exceeds the predetermined reference value, terminating a driving period of said first transistor and starting a driving period of said second transistor;

wherein the started driving period of said second transistor is controlled so that the started driving period is the same as the terminated driving period of said first transistor.

2. The method according to claim 1, wherein said comparing comprises comparing a first voltage detected on a shunt resistor connected in series to said first transistor to a reference voltage by a comparator.

3. The method according to claim 2, herein when said voltage is higher than said reference voltage, said comparator generates an over current signal of a high level.

4. The method according to claim 3, wherein said over current signal is used to trigger the termination of the driving period of said first transistor and the start of the driving period of said second transistor.

5. The method according to claim 4, wherein said first and second transistors are bi-polar transistors or MOSFETs.

6. The method according to claim 4, wherein the discharge lamp is a low voltage fluorescent lamp.

7. An electronic ballast circuit for regulating the ignition voltage of a discharge lamp, comprising:

a half-bridge inverter circuit comprising a first and a second transistor for supplying AC voltage to said discharge lamp;

a load circuit coupled between said discharge lamp and said half-bridge inverter circuit;

a detector for detecting the current flowing through one of said first and second transistor; and a logic control circuit for comparing the current detected by said detector with a predetermined reference value, and terminating the driving period of said first transistor and starting the driving period of said second transistor if the detected current exceeds the predetermined reference value, wherein the logic control circuit further controls the started driving period of said second transistor so that the started driving period is the same as the terminated driving period of said first transistor.

8. The electronic ballast circuit according to claim 7, wherein said detector is a shunt resistor connected in series to said first transistor, and that said logic control circuit comprises a comparator for comparing the voltage on said shunt resistor with a reference voltage.

9. The electronic ballast circuit according to claim 8, wherein said comparator generates an over current signal of a high level when said voltage is higher than said reference voltage.

10. The electronic ballast circuit according to claim 9, wherein said logic control circuit uses said over current signal to trigger the termination of the driving period of said first transistor and the start of the driving period of said second transistor.

11. The electronic ballast circuit according to claim 10, wherein said a first and a second transistor are bi-polar transistors or MOSFETs.

12. The electronic ballast circuit according to claim 10, wherein the discharge lamp is low voltage fluorescent lamp.

* * * * *